United States Patent [19]

Wenzlick et al.

[11] 4,230,382

[45] Oct. 28, 1980

[54] PLASTICS DRAWER FOR FURNITURE

[75] Inventors: Erich Wenzlick, Durlangen; Hermann Rothfuss, Waiblingen, both of, Fed. Rep. of Germany

[73] Assignee: BBP Kunststoffwerk Marbach Baier & Co., Fed. Rep. of Germany

[21] Appl. No.: 943,272

[22] Filed: Sep. 15, 1978

[30] Foreign Application Priority Data

| | | | |
|---|---|---|---|
| Sep. 20, 1977 | [DE] | Fed. Rep. of Germany | 2742328 |
| Nov. 17, 1977 | [DE] | Fed. Rep. of Germany | 2751412 |
| Aug. 4, 1978 | [DE] | Fed. Rep. of Germany | 2834152 |

[51] Int. Cl.[2] ..... A47B 88/00; A47F 5/00

[52] U.S. Cl. ..... 312/330 R; 312/320; 312/348; 248/222.4; 248/223.4

[58] Field of Search ..... 312/330 R, 320, 234.1, 312/263, 265, 214, 348; 108/152; 248/222.4, 223.4, 223.1, 223.2, 224.1, 224.2, 221.3, 295 C, 260, 272

[56] References Cited

U.S. PATENT DOCUMENTS

| | | | |
|---|---|---|---|
| 874,311 | 12/1907 | Doran | 248/272 |
| 1,794,700 | 3/1931 | McCaskey | 248/221.3 |
| 2,173,159 | 9/1939 | Ewan | 248/224.1 |
| 2,533,475 | 12/1950 | Koonter | 248/223.1 |
| 2,997,355 | 8/1961 | Preble | 312/348 |
| 3,002,630 | 10/1961 | Heisser | 248/224.2 |
| 3,273,952 | 9/1966 | Himelreich et al. | 312/330 R |
| 3,429,539 | 2/1969 | Lucietto et al. | 248/224.2 |
| 3,666,341 | 5/1972 | Little | 312/330 R |
| 3,986,318 | 10/1976 | McConnell | 248/222.4 |
| 4,079,852 | 3/1978 | Stoffregen | 312/330 R |

FOREIGN PATENT DOCUMENTS

| | | | |
|---|---|---|---|
| 1077792 | 8/1967 | United Kingdom | 248/224.1 |

*Primary Examiner*—Victor N. Sakran
*Attorney, Agent, or Firm*—William A. Drucker

[57] ABSTRACT

A plastic drawer for furniture which comprises, for the fastening of a frontal facing, in its front wall several openings which are arranged at intervals in the longitudinal direction for the passage of fasteners held on the frontal facing, characterized in that the drawer front wall (12) is preferably double-walled and comprises an inner wall (17) and an outer wall (18) extending at a distance therefrom and in that the openings (19) are arranged only in the outer wall (18) and in that the fastners are designed as rapid locking elements (21;121) which are fastened to the facing (16) and engage in the openings (19) from the exterior of the drawer (10) and engage behind the openings (19).

35 Claims, 15 Drawing Figures

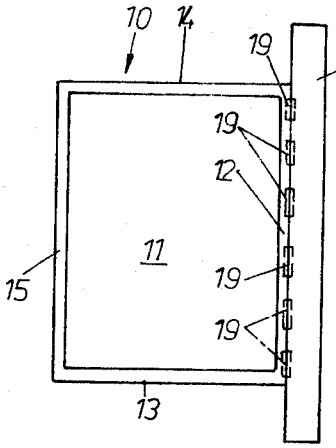
Fig. 1
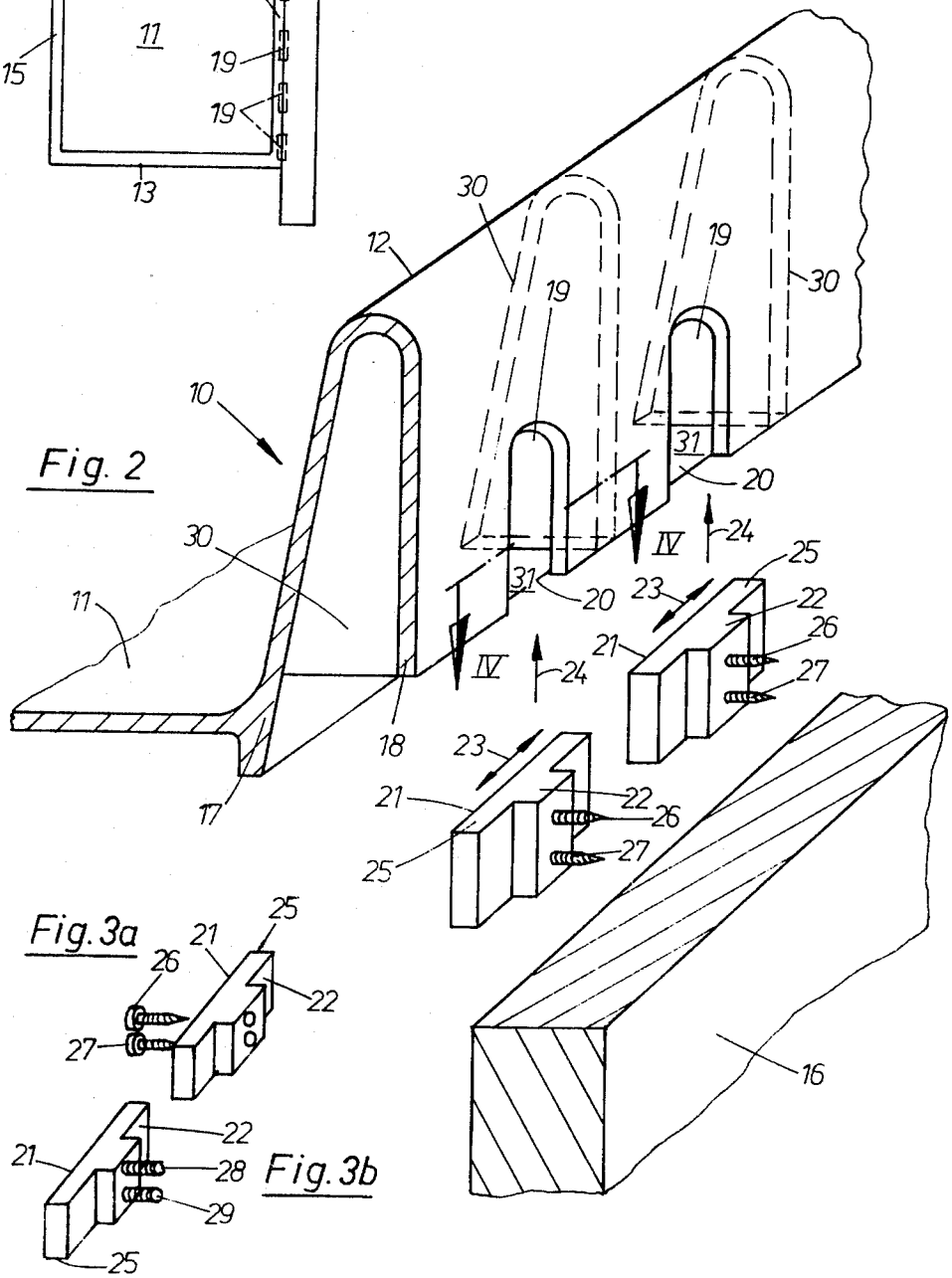
Fig. 2
Fig. 3a
Fig. 3b 210
211
212
213
216
217
218
219
221
222
223
224
225
226
227
228
229
230
231
232
233
234
235
237
239
240
241
242
246
247
248
251
260
261
262
270
271
272
273
274
275
IX

XI
XII
XIII
XIV

PLASTICS DRAWER FOR FURNITURE

BACKGROUND OF THE INVENTION

1. Field of the Invention

The invention relates to a plastic drawer for furniture which comprises in its front wall, for the fastening of a frontal facing, several openings, which are arranged at intervals in the longitudinal direction, for the passage of fasteners held on the frontal facing.

2. Description of the Prior Art

On known drawers of this kind, there are provided on the outside of the front wall longitudinal and/or transverse members to which the facing is attached. For the fastening of this frontal facing, the known drawer comprises in its front wall and on the inside directed towards the drawer interior two or three pockets which are arranged at intervals in the longitudinal direction and which are of approximately groovelike design and are open towards the drawer interior. The openings described at the beginning are located in the area of each pocket and serve for the passage of approximately pin-shaped fasteners, later to be anchored in the frontal facing, in the shape of screws which are placed through the openings from the drawer interior and are screwed into the facing. By this means, the facing is firmly pulled from the outside against the longitudinal and/or transverse members of the drawer front wall. The pockets can then be covered on the inside of the drawer front wall by means of cover strips which may, for example, be clipped on, detented and/or glued on and which close the pockets, which are open towards the drawer interior, so that the front wall inside forms a substantially smooth continuous surface. The mentioned openings may be designed as oblong holes so that the known fastening method allows a sensitive adjustment of the frontal facing within the plane set up thereby and relative to the drawer and thus an adaptation to dimensional variations, inaccurate bores in the facing etc. This known screw method has so far been the standard way of fastening the frontal facing. It has, however, some decisive disadvantages which will be discussed hereinafter. The essential disadvantage connected therewith is felt to be the necessity of closing the openings in the pockets, which are open towards the drawer interior, by means of special cover strips. It has turned out that, even when the adaptation is very good, there are left in the edge zone of the inserted cover strips chinks and grooves in which dirt is liable to accumulate and which are difficult to reach for cleaning. This is an important aesthetic and above all hygienic shortcoming since the aim is to provide for the drawer interior a smooth and continuous surface which can be properly and easily cleaned and has no corners or chinks where dirt accumulates and which are difficult to clean. The outlined fastening method is also disadvantageous because, viewed in its longitudinal direction, the facing is fixed at very specific intervals only, namely approximately in a point-like manner, causing, when the drawer base is heavily loaded and the latter is deformed as a result, the drawer front wall to be also deformed, at least in its upper edge zone, and to be slightly lifted from the inside of the screwed-on facing, and thus to form a gap which is also accessible to contamination and dirt that cannot be removed. The described screw fastening of the facing thus allows movements of the drawer front wall relative to the facing. There is therefore no guarantee that the facing will stay securely and immovably fixed to the drawer front wall all round, even when the drawer is subjected to stress. The facing is thus not completely included in the total drawer construction as an element which contributes to stiffen the drawer front wall. It is furthermore disadvantageous that the fastening of the facing to the drawer is relatively complicated and time-consuming and cannot be effected without special expert knowledge and special tools. This also becomes apparent in a disadvantageous manner when a screwed-on facing has to be later replaced against a new facing, for example because it has been damaged.

It has been attempted to overcome some of these disadvantages by fastening the frontal facing to dowels which project from the drawer front wall and sometimes also from the frontal narrow surfaces of the two drawer side walls. The facing is placed on these dowels and struck until the dowels firmly engage in the facing with their entire free length. Expediently, the places of the facing where the dowels are to engage in the latter are marked or pre-drilled. If this is not the case or if the marking is incorrect or the bores are fitted incorrectly, there results within the facing plane an incorrect relative position between the facing and the drawer. Subsequent corrections will be impossible. Even with an incorrect relative position and fastening, it is practice sometimes desired to be able to adjust the frontal facing relative to the drawer within the facing plane in retrospect, for example if the guideways for the drawer, which are fixed to the piece of furniture, do not extend exactly within a horizontal plane but extend, considered in the transverse direction, in a plane that is inclined somewhat to the left or right. The upper and lower edges of the facing will then accordingly extend obliquely to the right or left, which is unsightly and, for the rest, sometimes causes the facings to be jammed on adjacent furniture facing parts. Thus, this fastening method also has serious disadvantages, but it avoids openings in the drawer front wall which are open towards the drawer interior and have to be covered by means of special covering strips which mostly do not provide a complete closure. However, with this fastening method, there also has to be accepted that the frontal facing does not adjoin the drawer front wall fixedly and without gaps all round, that is to say that in the event of the drawer and the drawer front wall being deformed gaps will be formed between the front wall and the facing in which dirt accumulates. The facing is not incorporated in the construction as a stiffening element for the drawer front wall. The exchange of a damaged facing for a new facing is relatively complicated and can only be effected by trained staff.

The task underlying the invention therefore is to provide a plastic drawer of the defined species where the facing is fastened to the drawer front wall in such a way that there is no need for any openings in the inner surface of the drawer front wall, this surface thus forming a gap- and chink-free surface which is smooth and continuous with respect to the other inner surfaces of the drawer, and that the facing can furthermore be quickly and easily fastened to the drawer without specialised knowledge and without special devices or tools and can also be exchanged for another in the same manner and that, in any event, while the possibility of a subsequent adjustment in the longitudinal direction of the drawer front wall and in the vertical direction thereof is maintained, the facing can be firmly clamped all round against the front wall edge, the facing being simultaneously incorporated in the drawer construction as an element stiffening the front wall all round and resting so firmly against the front wall that even in the event of the drawer being heavily loaded, any deformation of the drawer front wall relative to the facing, and thus the formation of any gaps or chinks, is prevented.

SUMMARY OF THE INVENTION

Due to the design according to the invention, the front wall is smooth and continuous on its inside without the provision of any openings, pockets or the like which have to be covered by means of special covering strips. The drawer interior thus forms on all four inner drawer walls and on the base a single surface which is continuous and without any chinks and gaps, depressions or slots and which can be cleaned without presenting problems and is thus hygienically perfect. The fastening of the frontal facing is completely invisible from the outside and from the drawer interior. At the same time, one can now freely choose the individual fastening points because there are no openings which are open towards the drawer interior and must be covered. It is therefore possible to provide a plurality of individual fastening points in the longitudinal direction of the front wall and/or in the vertical direction thereof, including those points where the risk of the drawer front wall being deformed and being lifted from the facing is greatest when the drawer is loaded. Accordingly, one can distribute and choose the fastening points in such a way that the facing is tightly and firmly connected to the drawer front wall all round the edge thereof and remains fastened even when the drawer is loaded, without any chinks or gaps being formed. At the same time, it is ensured that the facing can by this means also be used as a stiffening element for the front wall, which serves for the further stiffening of the drawer in the area of the front wall. Nevertheless, the design according to the invention allows the facing to be quickly and easily fastened to the drawer without any specialised knowledge, auxiliary devices or tools and to be exchanged for a new facing in the event of it being damaged. The fastening and/or exchange can thus be effected directly on site, rapidly and without any aids. When produced separately, the facings can be pre-assembled in such a way that the rapid locking elements are fitted at the desired points of the facing. Thus provided with the rapid locking elements, the facings can then be separately supplied and fastened to the drawer in a direct and problem-free manner. No special assembly devices and aids are required for this purpose. All that is necessary for this fastening operation is to align the facing in the longitudinal direction and/or the vertical direction relative to the drawer and to secure the effected position of adjustment by special securing elements.

An advantageous constructional form is apparent from FIGS. 2 and 5. By this means, firstly a further stiffening of the front wall is brought about. It is furthermore ensured that the openings, behind which the rapid locking elements engage for fastening the facing, are additionally stiffened on both sides by transverse members, whereby any passage through the outer wall material on both sides of an opening is prevented in the fastening area when the facing is fastened. The facing is thus securely held in each fastening area without the risk of the outer wall being deformed and the facing thus being loosened.

Another advantageous constructional form is apparent from FIG. 2. This ensures that the facing is fastened, in the front wall longitudinal direction, as far as possible to the outside of the front wall so that any deforming forces hardly have an arm in this area, any lifting of the facing from the front wall thus being prevented in these end areas. Over and above this, the other openings in the outer wall of the front wall provide the possibility of chosing further fastening of the facing between these two end areas. If the facing is relatively long, fastening between these end areas may be effected, for example, not only in the centre but at two or three points therebetween. If it is not possible, due to the shape of the facing, handles acting thereon or the like reasons, to arrange rapid locking elements precisely in this area, then the latter may be arranged to the side thereof at different points and where the drawer front wall comprises in its front wall openings for the engagement of the rapid locking elements. A possibility of choice is thus also provided in this respect.

Another advantageous constructional form is contained in FIG. 2. Accordingly, a horizontal displacement of the facing relative to the drawer is possible with simple means for adjustment purposes, for example of the order of at least one to two millimetres. The facing can thus be quickly and easily adjusted in this direction.

Further advantageous constructional forms are contained in FIG. 2.

Another, particularly advantageous constructional form is contained in FIGS. 2 and 7. Widely varying possibilities, which are within the scope of the invention, are provided for the design of these rapid locking elements in this form.

Another advantageous constructional form is formulated in FIGS. 6 and 7. This design is particularly simple because it is possible to use herein, for example, conventional cheese-head screws which are then screwed directly into the facing. Instead, it is possible to use pins having cylindrical heads and which are driven into the facing or, better still, are dowelled therein with their shanks as dowels. Expediently, the rapid locking elements formed in this way or differently are made of plastics material and are thus moulded parts which are extremely cheap.

Further important constructional forms are contained in FIG. 5. The slots may be open towards the drawer underside. The facing is thus inserted for its fastening from the bottom and in such a way that the rapid locking elements enter the slots through the slide-in aperture, which is open towards the bottom, and, in so doing, engage from the outset with their engaging heads behind the front wall, on both sides of the slots, on the inside thereof. In the other constructional form, the slots are instead closed at both ends. In this design, the facing is placed transversely against the front wall with the rapid locking elements, namely in such a way that the wider engaging heads pass through the key-hole-like, fairly large slot aperture so that it is not until thereafter that a sliding movement between the facing and the drawer brings about the engagement of the respective engaging heads. It stands of course to reason that the key-hole-like large-sized aperture may just as well be provided in the centre of the slot length, when a displacement both to the top and to the bottom will be possible for fixing the facing. Furthermore, in another constructional form, each slot may also comprise several key-hole-like fairly large apertures which are arranged at intervals in its longitudinal direction. This depends on how the configuration of the rapid locking elements is chosen. For example, if two superimposed screws or pins with heads are provided as the locking elements for each slot on the facing, then the arrangement will be such that each slot can receive, for the fastening of the facing, the two headed screws or headed pins and thus has two superimposed key-hole-like large-sized apertures, one of which will be penetrated by an engaging head when the facing is joined.

Another constructional form is contained in FIGS. 6 and 7. This design is particularly simple. Such a screw, which engages in the gap between the engaging head and the inside of the outer wall, secures the adjusted relative position between the facing and the drawer both in the vertical direction and in the transverse direction. There may be used a wood screw which cuts itself into the material. This screw can be easily and rapidly inserted and screwed in from the drawer underside, which is open and freely accessible.

In addition thereto or instead, the arrangement may be made according to FIGS. 2, 6 and 7. Widely varying constructional configurations within the scope of the invention are provided for these means.

For example, the arrangement may be made according to FIGS. 6 and 7. The screw can engage in a screwing manner both through the holder of the rapid locking element and the socket. If the screw is only intended as an adjusting screw, then an engagement in the socket is not necessary. The screw then only engages in a screwing manner in the holder and sets with its overhanging length the vertical distance from the socket, on which it impinges with its free end. When an adjustment is effected, it is screwed into the socket, expediently in a self-cutting manner, this screwing-in providing the vertical adjustment of the facing, on the one hand, and simultaneously the fastening and securing in the vertical position thereof, on the other hand. Particularly for this configuration, a design as shown in FIGS. 6 and 7 may be advantageous.

Another advantageous constructional form is contained in FIG. 2. Depending on the configuration, the double wall of the drawer front wall is either completely obviated or is reduced to the holders.

As a rule, it is expected that the facing can be attached to the drawer initially in specified vertical and lateral positions in so-called zero positions of adjustment relative to the drawer and that special vertical and lateral adjustments will be effected only in individual cases and if necessary, starting from the zero position of adjustment as the reference position.

This is brought about by the features given in FIG. 11. By this means, the following can be attained. When the facing is placed against the drawer, then the shaped projection engages in the associated identically shaped recess in the drawer. By this means, a zero position of adjustment of the facing in the lateral direction relative to the drawer is specified from the outset. When the facing is then pushed downwards relative to the drawer, to allow the engaging heads of the rapid locking elements to engage behind the associated openings for interlocking, this specified zero position is maintained in the lateral direction. At the same time, the stops of the individual engaging heads strike against their associated stop surfaces on the drawer during this displacement of the facing in the vertical direction, whereby a zero position of adjustment between the facing and the drawer is specified in the vertical direction. If the external conditions of the furniture, into which the drawer is to be placed, dimensionally correspond to these conditions, then there is no need to shift the facing from this specified zero position of adjustment in the vertical or lateral direction. On the contrary, it can stay in the specified zero position and be tightened. If it turns out, however, that an adjustment should be effected in the lateral direction only but the zero position should be maintained in the vertical direction, then the facing can be displaced relative to the drawer in the lateral direction, namely in the transverse direction of the drawer front wall from left to right or vice versa from the zero position of adjustment. The stops continue to be in contact with their associated stops faces so that the zero position of adjustment specified in the vertical direction continues to be the reference position. During this lateral displacement, the stops are only displaced in the lateral direction to the left or right along their associated stop faces. A relative vertical displacement does however not occur. If, conversely, the specified zero position of adjustment in the lateral direction is to be maintained and an adjustment to occur instead in the vertical direction, in other words substantially at right angles to the drawer base, then the facing is upwardly or downwardly shifted relative to the drawer either uniformly or at the left or right end. Upon a displacement to the top, the stop are removed from their associated stop faces towards the top. Upon a displacement to the bottom, the stops pass their associated stop faces while urging back, for example spring-resiliently, the respective engaging heads carrying the stops. The specified zero position of adjustment in the lateral direction is maintained during this process, due to a special configuration. If a vertical adjustment from the zero position of adjustment is effected, for example, only at the right-hand end of the facing, then the specified zero position of adjustment is maintained as the reference position at the other facing end. The same applies to converse conditions. It is thus ensured that when joined and fastened to the drawer, the facing will be taken, relative to the latter, to predetermined zero positions of adjustment in the vertical and lateral directions without any special, sensitive manipulating work being required by hand. If, starting from this specified zero position in the vertical and lateral directions, there should be required, within a horizontal line, with a subsequent adjustment in the vertical direction of adjustment or conversely, a further adjustment differing from the zero position of adjustment, then the previously established position of adjustment is always maintained and is thus not changed. Therefore, the adjustment of the facing, starting from the specified zero position of adjustment, does not require any special care and manipulations. It is thus possible to fasten the facing to the drawer in an even faster and simpler manner without any specialised knowledge and special devices or tools while the position of adjustment set is secured at the same time.

FIG. 9 provides a particularly advantageous constructional form. Such surface elevations and depressions, more especially longitudinal and/or transverse grooves, secure, immediately when the rapid locking elements engage in the openings, a positional adjustment that has been effected on the facing, for example the zero position of adjustment, due to the high frictional grip between the surface elevations and depressions, ther being no need to manipulate securing elements in this early stage of use in order to secure the position of adjustment. It is furthermore ensured that, for example, a zero adjustment or an adjustment in advance in the horizontal direction will not be lost if a vertical adjustment has to be effected subsequently.

As explained, the openings are designed as slots which extend approximately at right angles to the drawer base and thus in the vertical direction of adjustment and which are preferably closed at both ends and which comprise approximately key-hole-like, fairly large apertures for the passage of the engaging heads of the respective rapid locking element. The slot length measured in the vertical direction is greater than the length of the rapid locking elements. Based on this configuration, FIGS. 9 and 12 contain another constructional form. This ensures that when the rapid locking elements are inserted into the associated slots, the spring tongues are bent in a spring-resilient manner as they engage behind the outer wall and thereby bring about a clamping action by means of which the rapid locking elements are clampingly held within the double-walled drawer front wall. The frictional grip produced by the surface elevations and depressions is increased as a result of the spring action exerted by the resilient spring tongues. There is thus secured a position of adjustment of the facing relative to the drawer, no securing elements having to be tightened in this advance position of adjustment. The facing can be easily brought into the finally desired position of adjustment relative to the drawer without any danger of the facing slipping relative to the drawer. On the contrary, the facing is secured in each position, even while adjustments are made, due to the surface elevations and depressions and the clamping force acting through the spring tongues. In other words, the facing can be released after each adjusting manipulation without slipping. This substantially facilitates the adjustment of the facing without necessitating special tools, expert knowledge or the like and there being no need, at this early stage, of securing the position of adjustment by the actuation of special securing elements.

Another advantageous constructional form is contained in FIGS. 8, 9, 11 and 14. The insertion block thus completely fills the hollow space in the double-walled drawer front wall. At the front, on the outer surface of its front strip, it is flush with the front surface of the outer wall. In the rear area, the rear surface of the insertion block rests snugly and with a large area against the inner wall. This measure causes any forces which may act on the facing during the later use of the drawer to be passed on to the drawer over a large area and reliably withoul local overloads and the danger of the drawer being damaged. At the same time, an insertion block shaped in this way is simple and cheap with respect to construction and production technique. The insertion of the rapid locking elements into the slots when the facing is placed against the drawer front wall is effected quickly and without problems. The two spring tongues engage in the associated open rectangular windows, while the front strip engages in the rectangular window associated therewith on this side. A subsequent displacement of the entire facing in the vertical direction of adjustment from top to bottom or vice versa then causes the two spring tongues to engage behind the outer wall of the drawer front wall, the spring tongues simultaneously springing out on one side and the rear surface of the insertion block being pressed against the facing outer surface of the inner wall. A configuration according to FIGS. 13 and 14 is of advantage. These longitudinal grooves allow a problem-free relative displacement between the drawer and the facing in the vertical direction of adjustment since the longitudinal grooves extend in the same direction. On the other hand, the frictional grip provided in the area of the longitudinal grooves prevents the facing from being slightly moved relative to the drawer in the horizontal direction and the preliminary position of adjustment thus being unintentionally changed. The spring tongues, which produce the clamping force, support this securing in position. A vertical adjustment of the facing is thus possible without any unintentional abandonment or change of the adjusted position in the transverse direction occurring during this process. Nevertheless, such an adjustment is possible in the horizontal direction. All that is needed to this end is a more powerful application of force on the facing so as to cancel the frictional grip between the longitudinal grooves. When the facing is released thereafter, it stays again reliably in the adjusted relative position to the drawer, due to the frictional grip provided between the longitudinal grooves and the spring tongues spring action. The interengaging longitudinal grooves thus secure this transverse adjustment in the horizontal direction but allow at the same time a smooth and problem-free adjustment in the vertical position of adjustment. When the latter has been brought about, the facing will not slip from the vertical position of adjustment reached, to which the high frictional grip and the spring force resulting from the spring tongues also contribute.

A design according to FIGS. 8, 9 and 11 is advantageous. This configuration of this spring tongues provides a high degree of spring elasticity. On the one hand, the spring strips themselves can spring out over their length. On the other hand, the root member is capable of also being deformed in a spring-elastic manner but offers more resistance to such a deformation. This leads to a high clamping force being provided by the spring tongues. This configuration of the spring tongues furthermore allows the facing to be transversely adjustable in the horizontal direction, thus enabling the insertion blocks sitting thereon to be displaced relative to the drawer front wall in the horizontal direction to the left or right. The spring tongues do not obstruct this transverse displacement. A design according to FIG. 9 is also advantageous.

Another advantageous constructional form is formulated in FIGS. 9 and 12. The oblique position results in the oblique spring strips being bent more and more from their oblique position to their vertical positions as the vertical displacement of the facing relative to the drawer increases and in the vertical position of adjustment and in the clamping force produced thereby being progressively increased. It is furthermore of advantage that the spring tongues do not oppose with any spring force the engagement of the insertion blocks in the slots before a vertical displacement in the direction but that this spring force is not produced until the vertical displacement of the facing relative to the drawer is effected in the vertical direction of adjustment. The joining of the facing and the engagement of the rapid locking elements in the associated slots thus occurs quickly and does not necessitate any spring forces to be overcome already at that stage by a special expenditure of force. The longitudinal grooves on the rear surface of the insertion block may extend from the upper end thereof to approximately the centre of the insertion block. This is sufficient. The longitudinal grooves provided on the drawer, namely on the outer surface of the inner wall expediently extend from the top to the bottom and approximately over half the height of the slot. They are then approximately double as long as the longitudinal grooves of the insertion block so that a relatively long displacement path is available to the insertion block in the vertical direction of adjustment and the longitudinal grooves which are associated with one another continue to be engaged over their lengths.

It may furthermore be of advantage if the slot is longer than the insertion block and if the lower edge limitation of the slot is lengthened towards the bottom relative to the length of the insertion block by approximately the length of a spring tongue. The insertion block will then impinge with its lower end on this lower edge when, after the facing has been joined and the insertion blocks engage in the slots, the facing is shifted completely towards the bottom in vertical direction of adjustment after the end stop of the upper or lower spring tongue, is overcome, which stop specifies the zero positon of adjustment in the vertical direction. Proceeding from this position of adjustment, it is still possible to make a correction in the vertical direction to an end area of the facing. This end position is maintained as the reference position on the other end area of the facing.

Another essential constructional form is formulated in FIG. 9. The clamping device is not brought into clamping engagement until the lateral and vertical adjustments have been made. Them the clamping device brings about in respect of each rapid locking element a firm pressing of the latter with the rear surface against the outer surface of the innerwall, whereby any vertical displacement of the facing relative to the drawer is rendered impossible, even when a considerable force acts on the facing, and simultaneously a transverse displacement in the horizontal direction, since, with the clamping device active, the longitudinal grooves extending in the vertical direction are now firmly pressed one within the other in an interlocking manner and this is effected not only by the spring action exerted by the spring tongues.

A configuration according to FIG. 9 can furthermore be of advantage. This is simple and cheap. The stirrup comprising the clamping head may be accommodated in the hollow space of the double-walled drawer side wall and/or front wall. These parts will then not be visible from the outside. No special space is required for their accommodation. There is also no need for the drawer walls to be thicker in cross section or to be larger with respect to their allowances for height.

A design according to FIG. 9 is of advantage. Expediently, the trough is open at both ends in the vertical direction of adjustment, but at least at that end at which the clamping head has to enter the trough upon the engagement of the insertion blocks in the slots and the subsequent vertical displacement of the facing.

The trough may be of a faintly trapezoidal configuration. The clamping head may in cross section have approximately the same configuration as the trough. A design according to FIGS. 8, 9 and 11 may furthermore be of advantage. This ensures that when the clamping head engages in the trough and when the said inner surface is acted on, substantially no force whatever is exerted on the insertion block in the horizontal direction which might otherwise entail a slight transverse displacement of the insertion block. When exerting tension with its head surface which is pressed against the inner surface, the clamping head acts on the inner surface substantially only in one direction which is approximately at right angles to the rear surface and directed towards this latter. The clamping head thus loads the insertion block, related to the rear surface thereof, practically only in the normal direction.

Another advantageous constructional form is formulated in FIGS. 8 and 9.

FIGS. 6, 8 and 9 describes an adjusting device. Of course, instead of such an adjusting device, there are other configurations within the scope of the invention which are suitable for applying to the clamping head an adjusting force which is directed in the adjusting direction, namely towards the trough.

A design according to FIG. 9 may furthermore be of advantage. By this means, there is provided in this central area a free space in which, for example, a handle part, which is fastened to the facing and which is pulled towards the rear surface of the facing and which projects from the remaining abut with its rear surface tightly and without gaps or grooves and be clamped despite this projection.

Further important constructional forms of the configuration according to FIGS. 9, 11 and 12 as well as that mentioned before will be explained hereinafter.

Another particularly advantageous constructional form is formulated in FIGS. 8, 10, 11, 12 and 14. There is thus no need of any provisions on the drawer, in the area of the openings, in order to provide a separate stop surface which is associated with the stop. The described configuration is therefore particularly simple and cheap.

In order to specify a secure zero position of adjustment in the horizontal line, it is expedient if on at least two rapid locking elements provided in the longitudinal direction of the facing at a distance from each other, there is provided on one engaging head each a thickening in material, with which the bottom edge of the associated rectangular window is associated as the stop surface.

Particularly advantageous configurations for the cooperating means for the specification of the zero position of adjustment in the lateral direction will emerge from FIGS. 2, 5 and 9. This design of the member, on the one hand, and the slot, on the other, is particularly simple and cheap. The member may be co-moulded when the rapid locking element, which is usually a plastics material part, is produced. The slot in the drawer may also be provided during the production of the drawer.

Consequently, the total expenditure for the means associated with one another for the specification of the zero position of adjustment in the vertical direction as well as in the lateral direction is practically zero. It is of no importance whatsoever with respect to the costs.

BRIEF DESCRIPTION OF THE DRAWINGS

FIG. 1 shows a diagrammatical top view of a plastic drawer with a frontal facing and fastening points between the facing and the drawer which are indicated in broken lines, FIG. 2 shows a perspective, exploded and partly sectional representation, on an enlarged scale, of a portion of the drawer front wall, the frontal facing and the rapid locking elements fastened to the latter before their engagement in openings in the drawer front wall, FIG. 3*a* shows a perspective view of a rapid locking element with fastening means for fastening to the facing, according to an exemplified embodiment, FIG. 3*b* shows a view like FIG. 3*a* but with fastening means according to another exemplified embodiment.

DESCRIPTION OF THE PREFERRED EMBODIMENTS

Figure 4:
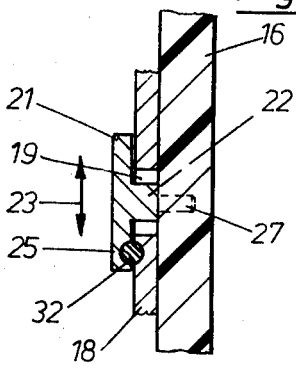
FIG. 4 shows a horizontal section along the line IV—IV in FIG. 2 of a portion of the facing fastened to the outer wall of the drawer front wall, with a rapid locking element in fastening engagement.

In the drawings, there is designated by 10 a plastic drawer which comprises in the usual way a base 11, a front wall 12, two The base 11, the front wall 12 and all the other wall parts 13 to 15 are integral. On the front wall 12, the drawer 10 is adapted for the fastening of a frontal facing 16 which is approximately plate-shaped and consists, for example, of wood. For this fastening, the front wall 12 comprises, as will still be explained later, several openings which are spaced from one another in the longitudinal direction and serve for fasteners acting on the frontal facing 16 to pass through, as will still be explained later.

As emerges particularly clearly from FIG. 2, the front wall 12 is double-walled. It comprises an inner wall 17 and an outer wall 18 which extends at a distance therefrom and whose outside is flat and substantially at right angles to the base 11. For the double wall, narrow outer strips which are held, for example, on supports, and are thus approximately U-shaped outer pockets in cross section, are sufficient instead of the outer wall 18.

As is discernible particularly clearly in FIG. 2, several openings 19 are arranged in the outer wall 18, and only in this wall, for fastening the facing 16. These openings are arranged at preferably equal intervals in the longitudinal direction of the front wall 12. The openings 19 are in the shape of slots which are provided in the outer wall 18 and extend in the vertical direction, namely at right angles to the base 11. In the exemplified embodiment shown in FIGS. 2 and 4, these slots are opened towards the drawer underside and have there a slide-in aperture 20 for the fasteners of the facing 16 still to be described.

The fasteners consist of rapid locking elements 21 made, in particular, of plastics material. These are fastened on the facing 16, namely on the side that is directed towards the outer wall 18. They are shaped in such a way that they engage in the openings 19 from the outside of the drawer 10 and engage behind the openings 19.

FIG. 2 shows particularly clearly that the space between the inner wall 17 and the outer wall 18 is subdivided into individual chambers 31 by means of cross members 30. The cross members 30 are integral with the inner wall 17 and the outer wall 18 and extend between both. Each of the openings 19 is arranged within the outer wall 18 section that extends between two adjacent cross members 30.

The example shown in FIG. 1 is to make it clear that an opening 19 is arranged in any event in the longitudinal direction of the drawer front wall 12 in both end areas of the outer wall 18 and close to the adjoining longitudinal side walls 13 and 14, there being arranged at the appropriate point on the facing 16 a rapid locking element 21 which engages in the respective opening in the end area. An opening 19 and an associated rapid locking element 21 are thus disposed at least in each end area. By this means, the fastening of the facing to the front wall 12 is ensured as far as possible on the outside and close to the longitudinal side walls 13 and 14.

Over and above this, there may be provided in the longitudinal section between these two end areas of the outer wall 18 further openings 19, preferably at equal intervals, as is also indicated in FIG. 1. There are indicated, by way of example, four further openings 19 in this longitudinal section between the openings in each end area. In all or some of these interposed openings 19 there may also engage, optionally and in dependence, for example, on the transverse dimensions of the drawer, associated rapid locking elements 21 of the facing 16. It is possible to chose here, for example, a dependence on the drawer dimensions, the thickness of the facing 16 and/or on whether handles, handle strips or the like are fastened to the facing 16 or whether the facing 16 is provided with a frieze. Depending on what is required, all or least some of the openings 19 are thus used between those in the end areas, with rapid locking elements 21 also engaging therein.

Measured in the longitudinal direction of the front wall 12, the rapid locking elements 21 are in their cross-sectional sections 22, engaging through the respective openings 19, narrower than the aperture width of the opening 19. By this means, there is provided an adjustability of the facing 16 in this longitudinal direction, according to the arrow 23, relative to the drawer 10. These different dimensions can be seen particularly clearly in FIG. 4, where the cross-sectional section 22 is clearly narrower than the aperture width of the opening 19.

As can furthermore be seen, the length of each individual opening 19, measured at right angles to the base 11, is, for example, larger by a multiple than the vertical dimension, measured in this direction, of the rapid locking element 21 sections engaging through the respective openings 19. By this means, there is possible an adjustability of the facing 16 in this vertical direction, according to the arrow 24, relative to the drawer 10.

Each of the rapid locking elements 21 basically comprises a section 22, which engages through the opening 19, and furthermore an adjoining engaging head 25 which is at a distance from the facing 16 and is preferably integral with the section 22. It is important that the engaging head 25 should have a dimension that is larger than the aperture width of the respective opening 19. The engaging head 25 engages on both sides of the opening 19 on the outer wall 18 inside that is remote from the facing 16 and pulls the facing 16 firmly against the outer wall 18 outside facing it. Important is in this connection that the distance between the contact that is directed towards the outer wall 18 is substantially equal to the cross-sectional thickness of the outer wall 18 or is somewhat smaller. The engaging heads 25 and/or the outer wall 18 inside may be additionally provided with wedge surfaces so as initially to ensure ease of movement when the facing 16 is inserted and not to cause the facing 16 to be tightened in the transverse direction and against the outer wall 18 until a specified insertion path has been run through.

In the exemplified embodiment shown in FIGS. 1 to 4 and FIGS. 6 and 7, the rapid locking elements 21 are designed as holders which are approximately T-shaped in cross section. The horizontal leg of the T forms the engaging head 25 and the vertical leg of the T the section 22. These thus shaped rapid locking elements 21 are fixed on the inside of the facing 16 by means of fasteners engaging in the latter. In the exemplified embodiment shown in FIG. *3a*, these fasteners consist in respect of each rapid locking element 21 of two screws 26 and 27 which are arranged one beneath the other and which penetrate associated bores in the rapid locking element 21 and which are screwed into the facing from the inside. This is also shown, for example, in FIGS. 4, 6 and 7.

In the other exemplified embodiment shown in FIG. *3b*, these fasteners consist in respect of each rapid locking element 21 of two dowels 28 and 29 which are arranged one beneath the other and which are integral with, for example co-moulded to the rapid locking element 21. and so is basically an inversion of the kinematic chain, i.e. an arrangement where the described rapid locking elements form part of the front wall 12, while the openings form part of the facing 16.

Prior to being fastened to the drawer 10, the facing 16 is available in its completed state of assembly, i.e. with the rapid locking elements 21, which are, for example, in the shape of the holders which are T-shaped in cross section, as shown in FIGS. 1 to 4, already fastened to the facing inside.

When the drawer 10 is made entirely of plastics material, the openings 19 have analogously already been provided in a fixedly specified number along the outer wall 18. The facings 16 and the drawers 10, which are thus ready for assembly, are as a rule supplied by different manufacturers, one being the furniture manufacturer and the other the manufacturer of the plastic drawer 10. For fastening the facing 16 to the front wall 12 of the drawer 10, the facing 16 is now placed with its inside against the outside of the outer wall 18, the rapid locking elements being in the vertical direction in alignment with the associated openings 19 and still below the slide-in aperture 20, into which the rapid locking elements 21 are to be introduced. Then, a sliding movement in the direction of the arrow 24 (FIG. 2) is performed by means of a relative movement between the drawer 10 and the facing 16, when the cross sections 22 of the rapid locking elements 21 are slid into the openings 19 from the bottom, with the engaging heads 25, that is to say the horizontal legs of the holders which are T-shaped in cross section in the exemplified embodiment shown in FIGS. 1 to 4, engaging behind the openings 19 on the outer wall 18 inside that is directed away from the facing 16 and in doing so firmly pulling the facing 16 against the outer wall 18 outside directed towards the facing. This pulling movement in the direction which is at right angles to the surface of the facing 16 may be further increased by wedge surfaces between the co-operating fastening elements. With the sliding-in in the direction of the arrow 24, the vertical adjustment of the facing 16 in the direction of the arrow 24 relative to the drawer 10 is simultaneously possible and to be effected. Thereafter, or at the same time, the transverse adjustment of the facing 16 in the direction of the arrow 23 may be effected relative to the drawer 10, which is made possible by the larger aperture width of the slot-shaped openings 19.

The vertical and/or lateral adjustments having been effected, the facing 16 is fixed on the drawer 10 in this adjusted position, for which a large number of possibilities within the scope of the invention present themselves.

In the simplest case, self-tapping screws are, for example, sufficient, as shown in FIG. 4. Accordingly, there acts on at least some of the rapid locking elements 21 a self-tapping screw 32 which secures the vertical and/or transverse positions of adjustment of the facing 16 relative to the drawer 10 and which is screwed in between the inside of the outer wall 18 and the engaging head 25 contact surface resting against the latter from the drawer 10 underside which is freely accessible to this end. Basically, it may be sufficient if at least the two rapid locking elements 21 and the two associated openings 19 in the outer wall 18 end areas measured in the longitudinal direction (FIG. 1) comprise such elements for securing the facing 16 when the adjustment has been effected.

If the facing 16 has to be detached again, for example if it has to be exchanged for a new one, this exchange can be brought about equally rapidly. For detaching the facing 16 the procedure is reversed and a new facing is then attached in the described manner. It is evident that the fastening of the facing 16 to the drawer 10 does not necessitate any specialised knowledge, assembly devices, other auxiliary tools or the like. The fastening operation can be effected in a rapid, simple and at the same time reliable manner. Another essential advantage resides in the fact that the fasteners between the drawer and the facing 16 are invisible from the outside and, above all, that no openings whatsoever in the inner walls of the drawer 10 are necessary to this end. The entire inner surface of the drawer 10 is thus smooth and continuous on all four walls and on the base 11 and has no chinks, gaps, depressions or the like. The completely smooth and continuous surfaces in the drawer interior can thus be cleaned in a hygienically perfect and in an easy and complete manner. It is moreover advantageous that a plurality of fastening points (see FIG. 1) can now be provided and that, at the same time, it is possible to chose the places where the provided openings 19 in the outer wall 18 will actually be furnished with fasteners. It is thus rendered possible to tighten the facing 16 firmly all round the outer wall 18 of the front wall 12, this fixed connection being maintained in the event of the drawer 10 being stressed and possibly deformed, with no detachments and gaps or slots resulting therefrom, above all in the upper edge area but also all round the other edges of the front wall 12. The fastening of the facing 16 thus leads to the facing being sumultaneously included as a constructional element in the drawer configuration so that, by this means, the front wall 12 is additionally reinforced and stiffened.

Figure 5:
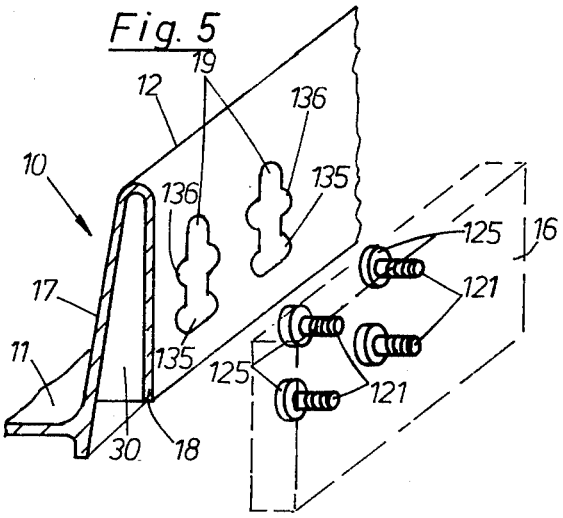
FIG. 5 shows a perspective view of a portion of a drawer with a facing portion, indicated in broken lines, according to a modified exemplified embodiment, prior to the fastening of the facing.

The exemplified embodiment shown in FIG. 5 differs from that shown in FIGS. 1 to 4 as well as 6 and 7 in that the rapid locking elements are designed as screws or pins with heads 121, preferably two of which are arranged below one another for each opening 19. The screws or pins with heads 121 are screwed or dowelled into the facing 16 from the inside. The engaging head 125 is formed directly by the head of the screw or pin 121, while the section engaging through the opening 19 is formed by the shank of the screw or pin 121. In a corresponding adaptation to this configuration of the rapid locking elements 121, the slot-shaped openings 19 are then, for example, closed at both ends and each have, in co-ordination to the grouping of the head screws or head pins 121, at one end and at a distance therefrom, above the same, an approximately key-hole-like fairly large aperture 135 and 136 respectively which allows the respective engaging head 125 to pass through. Instead, each opening 19 may of course just as well be designed as a slot which is open towards the bottom, as in the aforedescribed exemplified embodiment.

Figure 6:
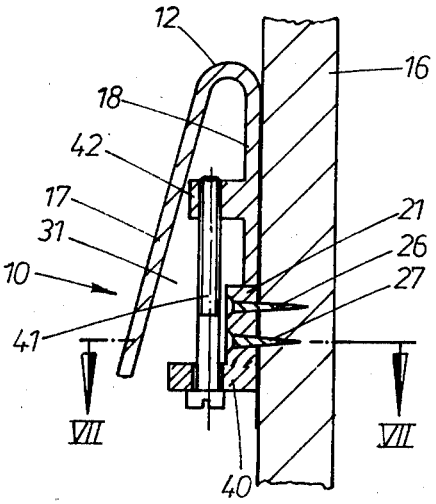
FIG. 6 shows a vertical section of a portion of the drawer, with a facing fastened thereto, according to a further exemplified embodiment.
Figure 7:
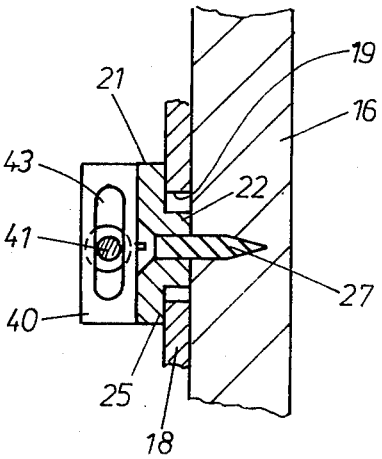
FIG. 7 shows a horizontal section along the line VII—VII in FIG. 6.

Irrespective of how the rapid locking elements and the associated openings are designed in the individual case, it may be of advantage if at least the two rapid locking elements 21 and the two associated openings 19 in the outer wall 18 end areas measured in the longitudinal direction (FIG. 1) have means, which are associated with one another, for the vertical adjustment of the facing 16 and for securing it after the vertical adjustment. FIGS. 6 and 7 show an exemplified embodiment. Therein, the rapid locking elements 21 comprise a holder 40 which projects beyond the engaging head 25 and further into the chamber 31 between the inner wall 17 and the outer wall 18 and which is shaped as a flat piece and is, for example, an integral part of the rapid locking element 21, and is thus co-moulded therewith. An adjusting and fastening screw 41 is screwed into the holder 40 from the underside of the drawer 10. In a corresponding co-ordination thereto, the front wall 12 of the drawer 10 comprises in the interior of the chamber 31, at the associated point, a socket 42 which is preferably integrally formed and is also approximately support-like. The latter is located above the slide-in aperture 20 of the slot-shaped opening 19 at a relatively large distance therefrom. The adjusting and fastening screw 41 is screwed in the support-like socket 42 when the facing 16 is fitted. Expediently, the screw 41 is freely rotatable in the holder 40 but cannot be axially displaced therein. This ensures that, after the facing 16 has been inserted from the bottom, the screw 41 can be screwed into the socket 42, for example in a self-tapping manner, the actuation of the screw causing the facing 16 to be pulled up further along the outer wall 18 and to be simultaneously adjusted vertically. In this configuration, the vertical adjustment of the facing 16, and simultaneously the securing of the position of adjustment set, and the securing of the facing 16 against its slipping down are effected solely and in one operation by the screw 41 screwed into the socket 42. As FIG. 7 shows, the holder 40 of the rapid locking element 21 comprises an oblong hole 43 which extends in the longitudinal direction of the front wall 12 and through which the screw 41 passes. The oblong hole 43 allows the facing 16 to be adjusted before the screw 41 is tightened in the transverse direction, namely in the direction of the oblong hole 43.

It is obvious that the drawer front wall 12 does not necessarily have to be provided with the outer wall 18 shown in FIG. 2 and in which the openings 19 are arranged. Instead of the outer wall 18, there may be integrally formed on the outside of the inner wall 17 cross and/or longitudinal members which point towards the facing 16 and form a stop surface for the latter. The openings 19 are then provided at least in the longitudinal members and have, for example, the same cross-sectional contour as the rapid locking elements 21 being used, namely for example T-shape. Instead, there may be formed on the outside of the inner wall 17 pockets or supporting brackets containing the openings 19. All these or similar configurations are within the scope of the invention provided that external wall parts are arranged, more especially formed, on the outside of the inner wall 17, which wall parts contain openings in which the rapid locking elements engage from the exterior of the drawer 10, the elements engaging behind these openings in a locking manner.

Figures 8, 9:
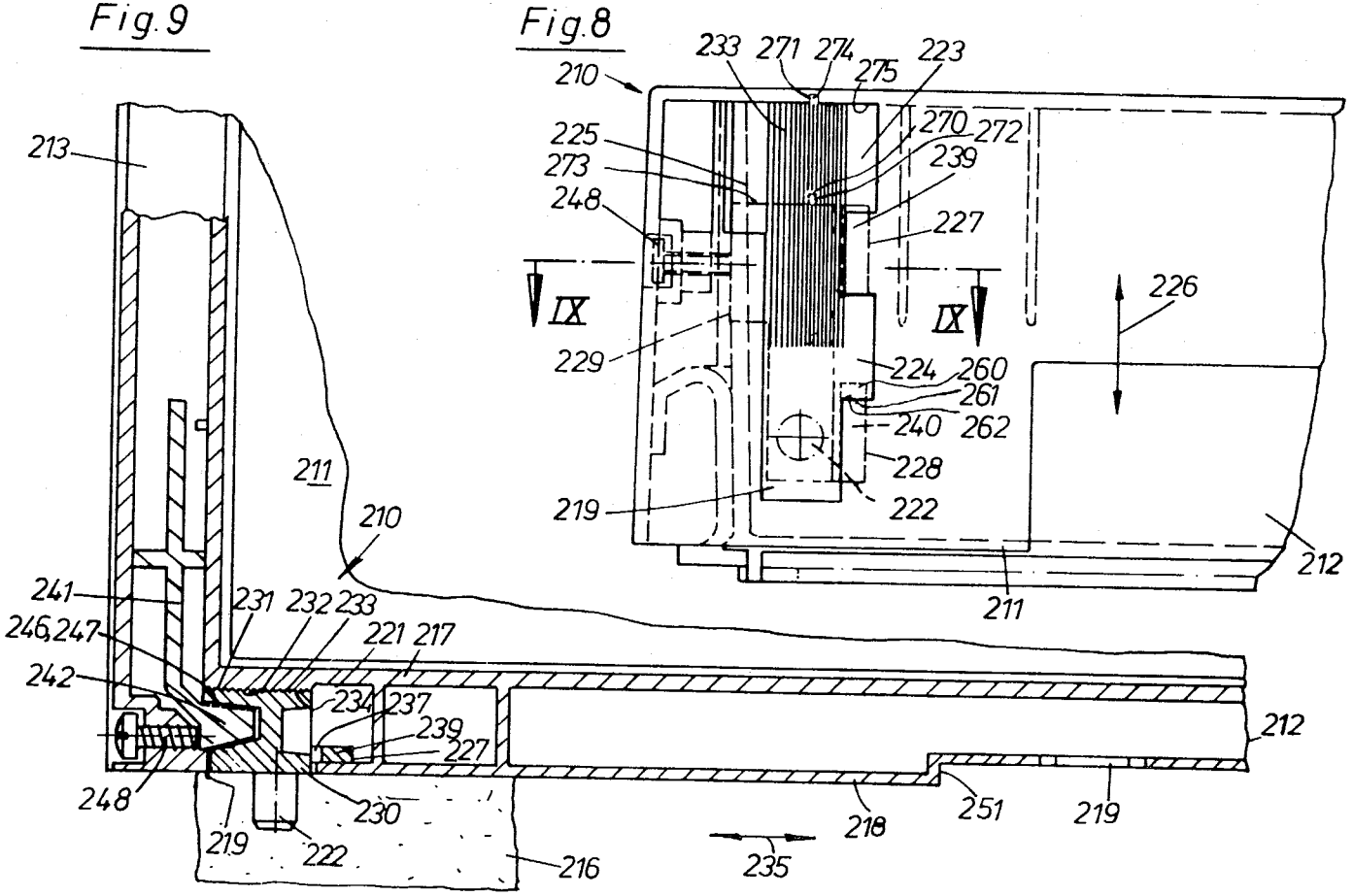
FIG. 8 shows a diagrammatical front view of the left-hand front end of a plastic drawer, with the facing omitted but with an engaged insertion block which is indicated in broken lines.
FIG. 9 shows a diagrammatical section along the line IX—IX in FIG. 8 of the left-hand front corner of the drawer.

In the drawings, there is designated by 210 a plastic drawer for furniture which comprising in the usual way a base 211, a front wall 212, two longitudinal side walls, of which only the left-hand longitudinal side wall 213 is discernible in FIGS. 8 and 9, as well as an invisible rear wall. The base 211, the front wall 212 and all the other wall parts are integral with one another. On the front wall 212, the drawer 210 is adapted for the fastening of a frontal facing 216 which is approximately plate-shaped and consists, for example, of wood. For this fastening, the front wall 212 comprises, quite generally speaking, several openings in the shape of slots 219 which are spaced in the horizontal direction and serve for fasteners acting on the frontal facing 216 to pass through, as will still be explained later.

As can be seen particularly clearly in FIG. 9, the front wall 212 is double-walled. It comprises an inner wall 217 and an outer wall 218 which extends at a distance therefrom and whose outside is flat and substantially at right angles to the base 211. The slots 219 for fastening the facing 216 are arranged only in this outer wall 218. They extend in the vertical direction, namely in the vertical direction of adjustment, and are thus approximately at right angles to the base 211. The slots 219 are closed at both ends, as shown in FIG. 8.

The further explanation of the slots 219 and the associated fasteners on the facing 216 is made particularly with reference to FIG. 9 and in respect of those parts which sit at the left-hand front end of the front wall 212 in FIG. 8. The fasteners for fastening the facing 216 consist of rapid locking elements 221 which engage behind the slots 219. On their fronts, the rapid locking elements 221 carry screws or dowels 222 which engage, for fastening, from the rear into the facing 216. Each rapid locking element 221 is designed as an insertion block having a substantially rectangular shape and consisting of plastics material.

The slot 219 in the outer wall 218 (FIG. 8) comprises on one side, which is to the right in FIG. 8, two approximately key-hole-like apertures, which lie one above the other at a distance, and on the opposite side, namely to the left in FIG. 8, an approximately identical aperture. These approximately key-hole-like apertures enlarging the slot aperture serve for the penetration of associated engaging heads on the rapid locking element.

The apertures which are to the right in FIG. 8 and are arranged above one another are formed as rectangular windows 223 and 224 which are open in the direction of the slot 219. Correspondingly, the approximately key-hole-like aperture on the left-hand side is also designed as a rectangular window 225 which is open in the direction of the slot 219. All the rectangular windows 223 to 225 extend substantially vertically, namely in the vertical direction of adjustment according to the arrow 226.

In corresponding association therewith, those engaging heads of the rapid locking elements 221 which are to engage in the two rectangular windows 223 and 224 located above one another (FIG. 8, right-hand side) are shaped as freely projecting spring tongues 227 and 228 which are capable of springing out, while the other portion associated with the opposite rectangular window 225 is shaped approximately as a flat block. The two spring tongues 227 and 228 as well as the flat block are integrally formed with the insertion block 221. The latter extends, with a front strip 230 of a transverse dimension that is smaller than the slot 219 (FIG. 9), within the plane of the outer wall 218 and is supported with its rear surface 231 on the inner wall 217 outer surface 232 pointing to the front (FIG. 9).

The rapid locking elements 221 as well as the surfaces of the drawer 210 which are associated therewith and with which the rapid locking elements 221 are in clamping contact, are basically provided with alternating surface elevations and depressions, for example grooves.

Accordingly, the outer surface 232 of the inner wall 217 of the drawer 210 comprises at the point where the insertion block 221 comes to rest with its rear surface 231 longitudinal grooves 233 which extend in the vertical direction of adjustment and which have been moulded in during the production of the drawer. In corresponding association therewith, the rear surface 231 of the insertion block 221 is also provided with vertically extending longitudinal grooves 234 which co-operate with the longitudinal grooves 233. It can be seen particularly clearly in FIG. 14 that the longitudinal grooves 234 on the rear surface 231 of the insertion block 221 extend only to approximately the centre of the insertion block 221 and thus approximately over half its length. The other longitudinal grooves 233 on the outer surfaces 232 of the inner wall 217 are however longer. They extend, starting from the top (FIG. 8), in the downward direction approximately over half the vertical dimension of the slot 219. This ensures that, upon the vertical displacement of the insertion block 221 within the slot 219, even by the dimension corresponding to the length of the longitudinal grooves 234 on the insertion block 221, the longitudinal grooves 233 and 234 will still remain engaged over substantially their entire length. Such a position of the insertion block 221 is indicated in broken lines in FIG. 8. One discerns that the flat block sits on the left-hand side within the rectangular window 225 and does not engage behind the outer wall 218.

The upper spring tongue 227 abuts on the right-hand side beneath the rectangular window 223 and on the rear of the outer wall 218 in an approximately bayonet-like manner. The same applies to the spring tongue 228 which is located therebeneath and also extends beneath the rectangular window 224 and also engages behind the outer wall 218, on the rear, in a locking manner. Both spring tongues 227, 228 produce a clamping force and press the insertion block 221 with its rear surface and the longitudinal grooves 234 provided thereagainst the outer surface 232 and the longitudinal grooves 233, provided there, of the inner wall 217. Since the longitudinal grooves 233, 234 extend parallel to the vertical direction of adjustment according to the arrow 226, an adjustment of the facing 216 in this direction is possible by a relative displacement of the latter with respect to the drawer 210, but a transverse displacement in the horizontal direction according to the arrow 235 is only possible, due to the high degree of interlocking between the longitudinal grooves 233 and 234 and the spring force exerted by the spring tongues 227 and 228, with a considerable expenditure of force by overcoming the spring force exerted by the spring tongues 227 and 228 and by disengaging the longitudinal grooves 233 and 234.

The two spring tongues 227 and 228 comprise root members 237 and 238, which project laterally from the insertion block 221 in the transverse direction (to the right in FIG. 10), and furthermore flat spring strips 239 and 240 which sit on the root members 237 and 238. The spring strips 239 and 240 extend in alignment and in the vertical direction of adjustment according to the arrow 226 and point with their free ends, which are the top ends in FIGS. 10 and 12, in the opposite direction to the slide-in direction, which allows the engaging locking engagement. As can be seen particularly clearly in FIGS. 9, 11 and 12, the two spring tongues 227 and 228 are moved back with respect to the front strip 230 and to the rear surface 231 of the insertion block 221, and this by approximately the cross-sectional thickness of the outer wall 218. It is furthermore of special importance that (see FIG. 12) the two spring strips 239, 240 are inclined, starting from their root members 237 and 238 up to the free upper ends and, when looked at prior to the insertion (FIG. 12), opposite to the slide-in direction and towards the front (to the left in FIG. 12) so that, when the insertion block 221 is inserted, the spring strips 239, 240 can press with their portions which spring out against the inner surface of the outer wall 218 on both sides of the slot 219 and press the insertion block 221 with its rear surface 231 and the longitudinal grooves 234 provided there against the outer surface 232, with its longitudinal grooves 233 provided there, of the inner wall 217.

Figures 10, 11, 12, 13, 14:
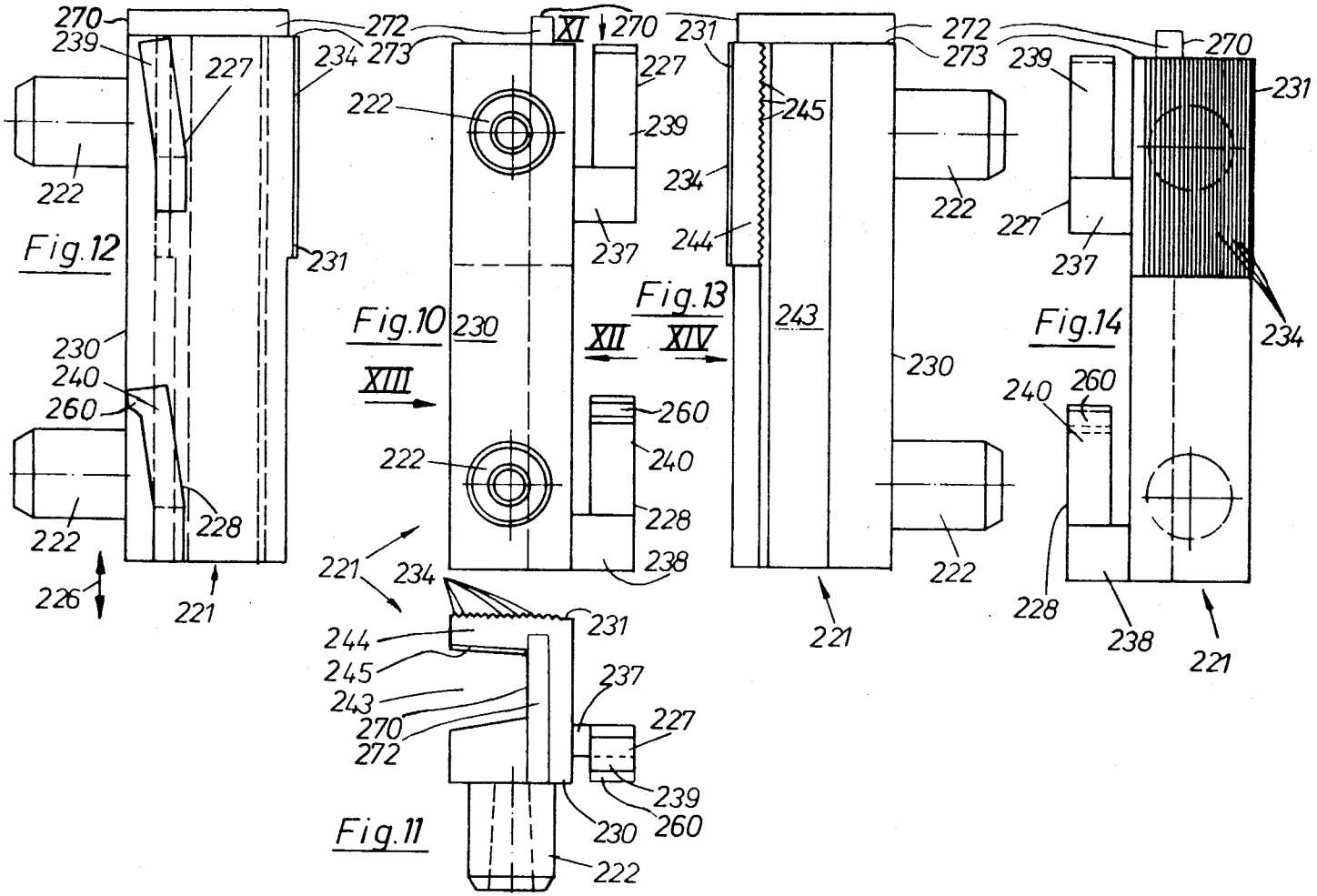
FIG. 10 shows a front view of the insertion block only.
FIG. 11 shows a top view of the insertion block in the direction of the arrow XI in FIG. 10.
FIG. 12 shows a side view of the insertion block side that is to the right in FIG. 10, in the direction of the arrow XII in FIG. 10.
FIG. 13 shows a side view of the insertion block side that is to the left in FIG. 10, in the direction of the arrow XIII in FIG. 10.
FIG. 14 shows a rear view of the insertion block, in the direction of the arrow XIV in FIG. 13.

It can be seen particularly clearly from FIG. 10 that the root member 238 of the lower spring strip 240 ends with the lower end of the insertion block 221. The free upper end of the upper spring strip 239 ends with the upper end of the insertion block 221.

For each rapid locking element in the shape of the insertion block 221 there is provided a clamping device (FIG. 9) which acts thereon and by means of which, after the facing 216 with its fixed insertion blocks 221 has been adjusted laterally and/or vertically, the latter can be pressed with their rear surfaces 231 against the outer surface 232 of the inner wall 217 in the lateral and/or vertical directions of adjustment so that they are immovable. The clamping surfaces of this clamping device and the associated surfaces of the insertion block 221 on which they act are provided with surface elevations and depressions, for example transverse grooves which extend in the lateral direction of adjustment according to the arrow 235 (FIG. 9) and which interengage when clamping is applied and form a protection against a relative displacement between the insertion blocks 221 and the front wall 212 in the vertical direction of adjustment according to the arrow 226.

In detail, the clamping device associated with the left-hand insertion block 221 in FIG. 9 comprises a strip-shaped stirrup 241 which is capable of springing out and has a clamping head 242 sitting thereon, which engages laterally in the insertion block 221. To this end, the insertion block 221 comprises, on the left-hand side in FIGS. 9 to 11 which faces the clamping head 242, a groove-like trough 243 which is open towards the clamping head 242. The trough 243 is open at both ends in the vertical direction of adjustment according to the arrow 226. It is of faintly trapezoidal design in cross section, with the clamping head 242 being approximately adapted to the trough 243 in cross section. Of importance for the clamping action to be provided is the inner leg 244 bounding the trough 243, in other words the leg which forms with its rear surface a portion of the rear surface 231 of the insertion block. This leg 244 is provided on its inner surface, which is directed towards the interior of the trough 243, with transverse grooves 245 which can be seen particularly clearly in FIG. 13. The clamping pressure of the clamping head 242 can be applied to the leg 244 on this inner surface provided with the transverse grooves 245. In corresponding association therewith, the clamping head 242 is provided with corresponding transverse grooves 247 on that head surface 246 which points to the leg 244 and the transverse grooves 245. It can be pressed, with this head surface 246 and the transverse grooves 247 provided therein, in a clamping manner against the leg 244 comprising the transverse grooves 245, while its other surfaces are out of contact with the insertion block 221, as FIG. 9 reveals.

So as to ensure that the clamping force exerted by the clamping head 242 on the above-described surfaces acts substantially in the direction of the normal relative to the outer surface 232 of the inner wall 217, the inner surface of the leg 244, which is provided with the transverse grooves 245, and the head surface 246, which is provided with the transverse grooves 247, both have a very weak trapezoidal angle of obliquity, for example of approximately 2°. This ensures that, when the clamping head 242 becomes active, there does substantially not act any force on the insertion block 221 which might displace the latter from the established transverse position of adjustment in the horizontal direction according to the arrow 235.

In FIG. 9 it can be seen that the clamping head 242 stirrup 241, which is capable of springing out, is arranged in the interior and in the front end area of the left double-walled longitudinal side wall 213 and comprises a frontal end portion which is offset into the front wall 212 and on which the clamping heard 242 sits. The stirrup 241 with the clamping head 242 is either inserted in the drawer 210 as a separate component or is anchored therein or is integrally formed on the drawer 210 as a plastic part, which is more advantageous.

Associated with the clamping head 242 is an adjusting device which is accessible from the drawer exterior and by means of which the clamping head 242 can be pressed into the trough 243 of the insertion block 221. Various possibilities of designing this adjusting device exist, one of which is indicated in FIG. 9. Here, the adjusting device consists of an adjusting screw 248 which is held on the front end in the longitudinal side wall 213 of the drawer 210 and is accessible from the side of the drawer 210 and from the outside. The adjusting screw 248 impinges with its flattened end on the side of the clamping head 242, which side is remote from the trough 243. When the adjusting screw 248 is tightened, the clamping head 242 is thus moved to the right in a slightly curved manner and further into the trough 243, as shown in FIG. 9, resulting in a frictional clamping of the insertion block 221, with its rear surface 231, against the outer surface 232 of the inner wall 217, the longitudinal grooves 233 and 234 provided therein being simultaneously pressed into even firmer interengagement. At the same time, the transverse grooves 245 on the leg 244 and the transverse grooves 247 on the head surface 246 are firmly pressed into one another. Interlocking and a high friction grip are provided. This renders impossible a vertical displacement of the facing 216 in the direction of the arrow 226 and also a lateral displacement in the direction of the arrow 235 when the adjusting screw 248 is firmly tightened.

In FIG. 8, it is indicated that the lower edge limitation of the slot 219 is extended towards the bottom approximately by the length of a spring tongue 227, 228 relative to the length of the insertion block 221. In the position taken up by the insertion block 221, indicated in broken lines in FIG. 8, the length that is available has not been fully passed through.

In FIG. 9, it is moreover indicated that the outer wall 218 of the front wall 212, as viewed in the transverse direction according to the arrow 235, is set back in a substantially balcony-like manner approximately in the central area in the direction of the inner wall 217 at 251. The pocket thus formed allows the facing 216 to rest, with its rear, snugly and flatly against the front surface of the outer wall 218, even when the facing 216 is provided in its central area with, for example, a superimposed handle part which is drawn towards the rear surface of the facing and projects from the rear surface of the facing 216. This projecting handle part is then accommodated in this pocket in the central area.

In another exemplified embodiment, which is not shown, there is provided instead of the two spring tongues 227 and 228 only one such tongue. The thus shaped engaging heads of the rapid locking element 221 may just as well be shaped in an entirely different manner, which is also within the scope of the invention.

For the fastening of the facing 216 to the drawer 210, the facing 216 is already completely assembled, i.e. the insertion blocks 221 are already fastened on its rear, at least at both ends to the right and left. For fastening the facing 216, the latter is placed with its rear against the outside of the outer wall 218 in such a way that the two spring tongues 227 and 228 lie on one side and the flat block 230 on the other side of the insertion block 221 at the level of the associated rectangular windows 223 and 224 and 225 of the slot 219 and can thus enter the rectangular windows at right angles to the outer wall 218. After the entry has been effected, the facing 216 is displaced relative to the drawer 210 in the direction of the arrow 226, and in the representation shown in FIG. 8 to the bottom, during which process the spring strips 239 and 240 pass onto the rear of the outer wall 218 in an approximately bayonet-like manner and lockingly engage behind the latter to the side of the slot 219. As the displacement of the facing 216 towards the bottom increases, the spring strips 239 and 240, which are placed obliquely towards the front counter to this direction of displacement, are now bent backwards in a spring-elastic manner (in FIG. 12 to the right), the clamping action thus being increased. The joined facing 216 rests with its rear surface substantially snugly against the outer surface of the outer wall 218. At the same time, each insertion block is supported with its rear surface 231 on the outer surface 232 of the inner wall 217. Due to the spring action exerted by the spring strips 239 and 240, the pressing of the insertion blocks 221, with their rear surfaces 231, against the outer surface 232 is increased. The longitudinal grooves 233 and 234 are interlocked like teeth and form an advanced safeguard against any displacement of the facing 216 of its own accord in the transverse direction according to the arrow 235. This securing in position is also increased by the spring action exerted by the spring strips 239 and 240. On account of friction of rest and spring action, the facing 216 can also not be displaced of its own accord in the vertical direction of adjustment according to the arrow 226. Then, the adjustment of the facing in the transverse direction according to the arrow 235 is effected in the desired manner. This is done by the application of force on the facing and by overcoming the detented engagement between the longitudinal grooves 233 and 234 and the spring force exerted by the spring tongues 227 and 228. Once the transverse adjustment in the direction of the arrow 235 has been effected, this position of adjustment is maintained due to the interengagement of the longitudinal grooves 233 and 234 and the spring action exerted by the spring tongues 227 and 228, even if a facing adjustment in the vertical direction of adjustment according to the arrow 226 is subsequently effected. Such an adjustment is possible because the longitudinal grooves 233 and 234 extend in the vertical direction of adjustment according to the arrow 226 and allow a relative displacement in this direction. At this stage, the adjusting screw 248 does not yet act clampingly on the clamping head 242 which has moved in from the bottom when the insertion blocks 221 were inserted and pushed down into the trough 243. The transverse grooves 245 and 247 provided there are either not yet in tooth-like locking engagement or only to such a slight extent that a vertical adjustment in the direction of the arrow 226 is still possible without any major expenditure of force. The adjusting screws 248 are not screwed in until the vertical adjustment in the direction of the arrow 226 is completed. First, the adjusting screw 248, which is on the left-hand side in FIG. 9, can be tightened and clamping be effected at that point, the possibility then being still provided of effecting vertical adjustments on the facing end area that is to the right in FIG. 9 and is not shown in detail. The tightening of the adjusting screw 248 causes the clamping head 242 to be pressed further into the trough 243 while the stirrup 241 is bent away in a spring-elastic manner, so that the head surface 246, including the transverse grooves 247 provided therein, presses against the leg 244 including the transverse grooves 245. This results in that the transverse grooves 245 and 247 enter into firm clamping interengagement, on the one hand, and that the insertion block 221 is now firmly pressed, with its rear surface 231, against the outer surface 232 of the inner wall 217, and this substantially only in the direction of the normal. The contact-pressure prevents a transverse displacement in the direction of the arrow 235 and a vertical displacement in the direction of the arrow 226 in the area of the rear surface 231, including the longitudinal grooves 234, and the outer surface 232, including the longitudinal grooves 233, even if a strong application of force occurs on the facing 216. A vertical displacement is additionally blocked by the fact that when contact-pressure is exerted by the clamping head 242 the transverse grooves 247 thereof are interlocked with the transverse grooves 245 of the leg 244 and thus form an additional positive safeguard against a displacement in the vertical direction according to the arrow 226. However, at the end that is to the right in FIG. 9 and is not shown in detail, the facing 216 can still be finely adjusted in the vertical direction until the adjusting screw provided is also firmly tightened there.

It goes without saying that instead of the longitudinal grooves 233, 234 and/or the transverse grooves 245, 247, other surface elevations and depressions are within the scope of the invention provided that they lead to an increased friction grip or interlocking engagement in the area of the surfaces which are in contact with one another. Instead of the grooves, there may be provided, for example, other surface roughnesses, for example in the manner of a knurl with alternating surface humps and depressions.

The following configuration, which can be seen particularly clearly in FIGS. 8, 10 to 14, is furthermore of special importance.

Each rapid locking element 221 held on the facing 216 comprises on one of its engaging heads a projecting, more especially integrally moulded stop 260 which co-operates with an associated stop surface 261 of the opening behind which this engaging head engages, when the engagement is effected, so as to specify a zero position of adjustment in the vertical direction according to the arrow 226 and which can be urged back, preferably in a spring-elastic manner, while this zero position of adjustment is overcome and for the passage along the stop surface 261.

In the exemplified embodiment shown, such a stop 260 for the specification of the zero position of adjustment in the vertical direction according to the arrow 226 is arranged on the lower spring tongue 228. There, the stop 260 consists of a material thickening which is formed so as to be integral on the front side and at the free end of the lower spring tongue 228.

The stop surface 261 associated with this stop 260 is provided on the lower edge 262 of that rectangular window 224 in which the lower spring tongue 228 can engage. The stop surface 261 is formed by the lower edge 262 of the rectangular window 224 itself.

Furthermore provided are means by which a zero position of adjustment in the lateral direction according to the arrow 235 is specified when the facing 216 is placed against the drawer. It is sufficient if such means are provided on only one of the existing rapid locking elements 221 and, in corresponding association therewith, on the drawer. These means of adjustment consist of a formed projection 270 which is integrally formed with a rapid locking element 221, on the one hand. On the other hand, they consist of a recess 271 which is associated with the formed projection 270 and is of identical form and is provided on the drawer in the associated area of the opening 219 through which the engagement is made. The formed projection 270 can engage in this recess 271, as the rapid locking element 221 engages, prior to the engaging locking, by specifying a zero position of adjustment in the lateral direction according to the arrow 235 (FIG. 9). When the rapid locking element 221 is displaced from this zero position of adjustment in the direction of the arrow 226 to the engaged position, the formed projection 270 is disengaged from the identically formed recess 271, the zero position of adjustment in the lateral direction according to the arrow 235 still being maintained but a lateral adjustment in the direction of the arrow 235 being possible.

As can be seen particularly clearly in FIGS. 10 to 14, the formed projection 270 consists of a member 272 which is aligned substantially at right angles to the front wall 212 of the drawer 210. The member 272 is arranged on the free upper edge 273 of one rapid locking element 221 which is shown. In height, it projects to the top from this free upper edge 273 and, as regards its length, it extends substantially over the entire cross-sectional thickness of the front wall 212. The member 272 is of approximately rectangular shape in cross section. The associated identically formed recess 271 is designed as a groove 274, which is open towards the opening 219, in the outer wall of the drawer 210. The groove 274 is located in the upper edge limitation 275 of the opening 219.

When the facing 216 is placed against the drawer 210, the rapid locking elements 221 engage in the associated openings 219. During this process, the facing 216 is so aligned that the member 272, which is provided at least on one side, for example to the left, extends at the same level and alignment as the groove 274 in the outer wall 218 does, so as to specify the zero position of adjustment in the lateral direction according to the arrow 235. The groove 274 is thus a guide to the member 272 and thus to the facing 216. Then, the facing can be placed against the drawer in the direction that is approximately at right angles to the front wall 212, the respective rapid locking elements 221 engaging in the associated openings 219. The two spring tongues 227 and 228 then engage in the associated rectangular windows 223 and 224. With this manipulation, there is thus specified, for the relative position between the facing 216 and the drawer 210, by the member 272 and the groove 274 a zero position in the lateral direction according to the arrow 235 in which the facing can stay even if no special adjusting work is necessary in the lateral direction according to the arrow 235. The facing 216 can then be moved downwards in the vertical direction according to the arrow 226. This causes the member 272 to be disengaged from the groove 274 in the downward direction. Nevertheless, the specified lateral position of adjustment in the direction of the arrow 235 is maintained because the longitudinal grooves 234 are engaged with those of 233. As the facing is displaced downwardly, the upper spring tongue 227 passes behind that portion of the outer wall 218 which is located in the area of the opening between the rectangular windows 223 and 224. The spring tongue 227 thus engages behind the outer wall 218 in a locking manner. Similarly, the lower spring tongue 228 engages behind the outer wall 218 in the area which is disposed beneath the rectangular window 224. This is shown in FIG. 8. The facing 216 has been moved down in the direction of the arrow 226 to such an extent that it now takes up the zero position of adjustment in the vertical direction according to the arrow 226; for in this position the stops 260 strike from the top against the free upper end and, at the front of the lower spring tongue 228, against the bottom edge 262 of the lower rectangular window 224. This happens at least with two spaced rapid locking elements 221. By this means, the facing is thus given the zero position of adjustment in the vertical direction according to the arrow 226. In a normal case, the alignment can stay like this and the facing can now be locked in this position by means of the screws 248. However, if for purposes of adjustment changes from this zero position of adjustment in the vertical direction according to the arrow 226 are necessary, then the facing 216 is moved further downwards in the direction of the arrow 226 with somewhat greater force. The stops 260, which have run onto the lower edge 262, are then pressed from the lower edge 262 transversely and in the direction that is approximately at right angles to the front wall 212 to the rear, while the lower spring tongue 228 is more severely elastically bent out. If the facing 216 is then moved further down in the direction of the arrow 226, then the stops 260 will also be on the rear of the outer wall 218 in that area which adjoins towards the bottom the rectangular window 224 and the lower edge 262 thereof. This further displacing movement in the direction of the arrow 226 towards the bottom is limited in that finally the lower edge of the rapid locking element 221 impinges on the lower edge limitation of the opening 219.

We claim:

1. In a drawer, made of plastics material, for furniture, comprising:
   (i) a base
   (ii) a front wall including an inner wall portion which is smooth and continuous and which is integrally joined to said base
   (iii) support means provided at least adjacent to longitudinal ends of said front wall, said support means being spaced forwardly of said inner wall portion, said support means including an opening therein,
   (iv) a facing abutting an outer face of said support means, and
   (v) locking means projecting from the facing and adapted to extend each through the opening of a respective support means and to abut an inner face of said support means, thereby to secure the facing to the support means, the improvement which comprises:
   (a) that part of said support means which includes said opening is a wall extending in the longitudinal direction of the front wall of the drawer,
   (b) said locking means each include a stem portion to extend through said opening, and a head portion to abut the inner face of the support means,
   (c) the width of said opening measured in the longitudinal direction of the front wall is greater than the width of the stem portion measured in that direction, and
   (d) the length of said opening measured in the height dimension of the front wall is greater than the height of the stem portion, whereby said facing is adjustable on said front wall both in the longitudinal direction and in the height dimension of the front wall.

2. A drawer, as claimed in claim 1, wherein the wall of the support means extends between cross-members secured to the inner wall portion.

3. A drawer, is claimed in claim 1, wherein said locking means are screws, the shank of the screw constituting said stem, and the head of the screw constituting said head.

4. A drawer, as claimed in claim 1, wherein said locking means are substantially T-shaped elements.

5. A drawer, as claimed in claim 1, wherein the base is plane, and wherein said openings of the support means are slots extending substantially normal to the plane of the base.

6. A drawer, as claimed in claim 5, wherein said openings are slots which are open at their end nearer the plane of the base.

7. A drawer, as claimed in claim 1, wherein said openings are slots which are closed at both ends and which formed at one end with an enlargement to permit passage of the head portion of the locking means.

8. A drawer, as claimed in claim 1, further comprising a screw, engaged between the head portion of the locking means and the inner face of the support means to secure the locking element in a selected position of adjustment with respect to the support means.

9. A drawer, as claimed in claim 1, wherein at least for those locking elements and associated openings which are disposed adjacent the longitudinal ends of the front wall, there are provided means serving for adjustment of the facing, relative to the front wall, in the height dimension of the front wall, and serving for securing the facing after such adjustment.

10. A drawer, as claimed in claim 9, wherein the locking means has a holder extending from said head into a space between the wall of the support means and the inner wall of the drawer, and wherein the front wall comprises a socket disposed in said space, and wherein an adjusting and securing screw is engaged through said holder and is threaded into said socket.

11. A drawer, as claimed in claim 10, wherein said adjusting and securing screw is freely rotatable in said holder but is prevented from axial movement therein.

12. A drawer, as claimed in claim 10, wherein said holder has a hole, to receive said screw, which is elongated in the longitudinal direction of the front wall, thereby to permit adjustment of the facing in the longitudinal direction of the front wall.

13. A drawer, as claimed in claim 1, wherein the wall of the support means is incorporated in a front wall portion of the drawer.

14. A drawer, as claimed in claim 1, characterised in that each locking means comprises on said head portion a projecting stop, and the wall of the support means having said opening includes a stop surface which cooperates with said stop to define a zero position of adjustment in the vertical direction, said stop being adapted to be urged back in resilient manner for overcoming the zero position of adjustment, and in that at least one of the locking means has a projection with which there is associated in the area of the wall having said opening, a recess in which the projection engages upon engagement of the locking means, prior to locking, to define a zero position of adjustment in the lateral direction, said projection being adapted to pass from said recess upon displacement of the locking means from said zero position of adjustment to the engaging position, and to be disengaged while giving up the zero position of adjustment in the lateral direction.

15. In a drawer, made of plastics material, for furniture, comprising:

(i) a base (ii) a front wall including an inner wall portion which is smooth and continuous and which is integrally joined to said base (iii) support means provided at least adjacent to the longitudinal ends of said front wall, said support means being spaced forwardly of said inner wall portion, said support means including an opening therein, (iv) a facing abutting an outer face of said support means, and (v) locking means projecting from the facing and adapted to extend each through the opening of a respective support means and to abut the inner face of said support means, thereby to secure the facing to the support means, the improvement which comprises:

(a) that part of said support means which includes said opening is a wall extending in the longitudinal direction of the front wall of the drawer, (b) said locking means each include a stem portion to extend through said opening, and a head portion to abut the inner face of the support means, (c) the respective faces of the head portion and of the support means which come into abutment are each provided with alternating surface elevations and depressions, (d) the width of said opening measured in the longitudinal direction of the front wall is greater than the width of the stem portion measured in that direction, and (e) the length of said opening measured in the height dimension of the front wall is greater than the height of the stem portion, whereby said facing is adjustable on said front wall both in the longitudinal direction and in the height dimension of the front wall.

16. A drawer, as claimed in claim 15, wherein said alternating surface elevations and depressions are formed by longitudinal grooves.

17. A drawer, as claimed in claim 15, wherein said alternating surface elevations and depressions are formed by transverse grooves.

18. A drawer, as claimed in claim 14, wherein the openings are formed as slots which extend approximately at right angles to the base of the drawer, and thus in the vertical direction of adjustment, and which are closed at both ends and which have approximately keyhole shaped apertures for the passage of the engaging heads of the respective locking means, and wherein the length of the slots, measured in the vertical direction, is greater than that of the locking means, the slots comprising in the outer wall on one side two keyhole shaped apertures which lie one above the other at a spacing and, on the opposite side, at least one aperture which is shaped as a rectangular window which extends in the vertical direction of adjustment and is open laterally towards the slots, the engaging heads of the locking means which are associated with the two rectangular windows lying one above the other and being shaped as freely projecting spring tongues which can spring out at least at their free end.

19. A drawer, as claimed in claim 18, characterised in that the two spring tongues are formed integrally with the side edges of a locking means which is designed as a plastic insertion block of substantially rectangular shape, said block extending by a front strip, whose transverse dimensions are somewhat smaller than those of the slot, within the plane of the outer wall, and which is supported at its rear surface on the front outer surface of the inner wall.

20. A drawer, as claimed in claim 14, characterised in that the outer surface of the inner wall and the rear surface of the insertion block comprise longitudinal grooves extending in the vertical direction of adjustment.

21. A drawer, as claimed in claim 14, characterised in that each of the spring tongues comprises a root member which projects laterally from the insertion block in the transverse direction and a spring strip which sits on the root member and which extends in the vertical direction of adjustment and points by its free end in the direction opposite to the direction of sliding in.

22. A drawer, as claimed in claim 14, characterised in that the spring tongues are set back with respect to the front strip and towards the rear surface of the insertion block by approximately the cross-sectional thickness of the outer wall.

23. A drawer, as claimed in claim 20, characterised in that the spring strips are obliquely positioned, starting from the root members up to their free ends and considered prior to insertion, in the opposite direction to the slide-in direction and towards the front so that, when the locking means is inserted their end areas press against the inner surface of the outer wall to the side of the slot in a resilient manner and press the locking means with its rear surface against the outer surface of the inner wall, the root member of the lower spring strip ending with the lower end of the insertion block, and in that the free ends of both spring strips point upwardly, and in that the end of the upper spring strip ends with the upper end of the insertion block.

24. A drawer, as claimed in claim 20, characterised in that the longitudinal grooves on the rear surface of the insertion block extend from the upper end thereof to approximately the center of the insertion block, and in that the longitudinal grooves on the outer surface of the inner wall extend from top to bottom approximately over half the height of the slot.

25. A drawer, as claimed in claim 14, characterised in that the slot is longer than the insertion block, and in that the lower edge of the slot is lengthened downwardly by approximately the length of a spring tongue relative to the length of the insertion block.

26. A drawer, as claimed in claim 14, characterised in that there acts on each locking means an associated clamping device by means of which, following the lateral and/or vertical adjustments of the facing with the locking means fixed thereto, the latter can be pressed with their rear surfaces against the outer surface of the inner wall in the lateral and/or vertical directions of adjustment in a non-displaceable manner, and in that the clamping surfaces of the clamping device and the associated locking means acted on thereby comprise transverse grooves which extend in the lateral direction of adjustment and which interengage when clamping is applied and form a protection against relative displacement occurring between the locking means and the drawer front wall in the vertical direction of adjustment.

27. A drawer, as claimed in claim 26, characterised in that the clamping device comprises, at least for each locking means which sits outside and close to the drawer side walls, a clamping head held on a stirrup and capable of springing out, and which engages laterally in the insertion block, and in that there is associated with the clamping head an adjustable device which is accessible from the drawer exterior and by means of which the clamping head can be pressed into the insertion block.

28. A drawer, as claimed in claim 14, characterised in that the clamping block comprises on its side that is directed towards the clamping head a groove-like trough which is open towards the clamping head and in which the clamping head engages, and in that the trough is open at both ends in the vertical direction of adjustment, and in that the trough is slightly trapezoidal in cross-section, and in that the clamping head has approximately the same configuration as the trough in cross-section.

29. A drawer, as claimed in claim 26, characterised in that the inner leg, which bounds the trough, forms with its rear surface a portion of the rear surface of the insertion block and comprises on its inner surface, directed towards the interior of the trough, the transverse grooves, and can be acted upon with the clamping pressure of the clamping head on this inner surface, and in that the clamping head comprises the transverse grooves on its head surface pointing towards the inner surface and can be pressed with this head surface against the inner surface in a clamping manner, while its other surfaces are out of contact with the insertion block, and in that the inner surface of the trough and the head surface of the clamping head, which comprise the transverse grooves, have a trapezoidal angle of obliquity of approximately 2°.

30. A drawer, as claimed in claim 27, characterised in that the slamping head stirrup, which is capable of springing out, is arranged in the interior and in the frontal end area of the double-walled drawer side wall, and comprises a frontal end portion which is offset into the drawer front wall and on which the clamping head sits, and in that the stirrup with the clamping head is inserted in the drawer as a separate component and is held therein or is integrally formed with the drawer as a plastics material part.

31. A drawer, as claimed in claim 27, characterised in that the adjusting device comprises an adjusting screw which is held in the drawer side wall and which is accessible from the side of the drawer and from the outside and whose end acts on the clamping head side that is remote from the trough in the adjusting direction of the trough.

32. A drawer, as claimed in claim 14, characterised in that the outer wall of the drawer front wall is set back, as viewed in the transverse direction, in an approximately step like manner approximately in the central area towards the inner wall.

33. A drawer, as claimed in claim 19, characterised in that the stop for defining the zero position of adjustment in the vertical direction of adjustment is arranged on the front side and the free end of a spring tongue and projects from the front surface thereof, and in that the stop is formed by a material thickening of the spring tongue, and in that the stop surface associated with the stop is provided on the lower edge of that rectangular window in which the spring tongue engages, and in that the stop surface is formed by the lower edge of the rectangular window itself.

34. A drawer, as claimed in claim 23, characterised in that the formed projection consists of a member which is aligned transversely to the front wall of the drawer and in that the member is arranged on the free upper edge of one locking means and porjects in its height towards the top beyond this edge, and in that the member is of rectangular shape in cross-section.

35. A drawer, as claimed in claim 34, characterised in that the indentically formed recess is designed as a groove which is open towards the opening in the front wall of the drawer, and in that the groove is arranged on the upper edge of the opening.

* * * * *